US006118969A

United States Patent [19]

Curry et al.

[11] Patent Number: 6,118,969

[45] Date of Patent: Sep. 12, 2000

[54] ELECTROPHOTOGRAPHIC FUSER ROLL HAVING DISTRIBUTED THERMAL MASS

[75] Inventors: Steven A. Curry, Nicholasville; Jichang Cao, Lexington, both of Ky.

[73] Assignee: Lexmark International, Inc., Lexington, Ky.

[21] Appl. No.: 09/394,266

[22] Filed: Sep. 10, 1999

[51] Int. Cl.[7] ..... G03G 15/20

[52] U.S. Cl. ..... 399/334; 219/216; 432/60

[58] Field of Search ..... 399/334, 330; 219/216; 432/60

[56] References Cited

U.S. PATENT DOCUMENTS

| | | | |
|---|---|---|---|
| 3,726,338 | 4/1973 | Sorenson | 165/89 |
| 4,585,325 | 4/1986 | Euler | 355/3 FU |
| 4,614,565 | 9/1986 | Riihinen | 162/206 |
| 4,639,990 | 2/1987 | Schiel et al. | 29/116 R |
| 4,683,628 | 8/1987 | Schonemann | 29/116 R |
| 4,937,600 | 6/1990 | Hirabayashi | 346/160.1 |
| 5,304,784 | 4/1994 | Tagashira et al. | 219/543 |
| 5,331,384 | 7/1994 | Otsuka | 355/290 |
| 5,481,346 | 1/1996 | Ohzeki et al. | 355/285 |
| 5,724,639 | 3/1998 | Tamura et al. | 399/333 |
| 5,742,865 | 4/1998 | Yajima et al. | 399/43 |

FOREIGN PATENT DOCUMENTS 4-93971 3/1992 Japan .

*Primary Examiner*—Richard Moses
*Attorney, Agent, or Firm*—John A. Brady

[57] ABSTRACT

A fuser hot roll for use in an electrophotographic process is disclosed. This roll is constructed such that the center portion of the roll's length has a greater thermal mass per unit length than each of the end portions of the roll's length. This can be accomplished either by constructing the center portion from a material which has a higher thermal capacity than the materials used for constructing the end portions, or constructing the center portion such that it is thicker than the end portions of the roll. The rolls of the present invention provide a simple way for regulating the fuser temperature such that it is uniform across the length of the hot roll, is uniform between the transitory (heat up) state and the steady state, and minimizes hot roll temperature overshoot during the transitory phase. The image fixing apparatus which incorporates this hot roll is also disclosed.

25 Claims, 7 Drawing Sheets

ELECTROPHOTOGRAPHIC FUSER ROLL HAVING DISTRIBUTED THERMAL MASS

TECHNICAL FIELD

The present invention relates to a design for a hot roll fuser used to fix images in electrophotographic processes, such as in photocopiers or computer printers.

BACKGROUND OF THE INVENTION

Hot roll fusers are frequently used to fix toner images in the so-called electrophotographic process. In such processes, toner is transferred from a photo-sensitive drum to paper, then heated (for example, using a hot roll fuser), thereby melting thermoplastic components of the toner and fixing the image to the paper. The electrophotographic process has found wide use in, for example, dry copying machines, laser printers, LED printers, and printing units of facsimile systems. To permit the use of a compact light-weight fixing unit in the electrophotographic process and to allow the unit to be heated to its operating temperature in a shortened period of time, the fixing element is frequently in the form of a cylindrical aluminum tube, which acts as a roller, having a halogen lamp inserted therein to heat the roller.

When the printing device is switched on, the roll goes through an initial heating period, called the transitory state, during which time the roller is heated up to operating temperature of from about 180° to 200° Celsius. At that point, the roll is in a steady state temperature mode during which time the temperature is maintained at operating (i.e., fixing) temperature. Maintaining a constant hot roll temperature along the length of the roll, as well as under different operating conditions from transient to steady state, is difficult, especially at higher printing speeds. Current hot fuser rolls contain a heating lamp with an energy profile that is boosted at its ends relative to its center by about 50% to try to compensate for roller heat loss which occurs at the end of the rolls. During the transient state or initial heating of the roll, the temperature at the center of the hot roll is greater than the temperature at the ends. As pages are printed, the center and end temperatures of the roll cross over. During steady state operation of continuous printing at higher printing speeds (e.g., about 34 pages per minute (ppm)), the temperature at the center of the hot fuser roll has been measured to be as much as 23° C. less than the temperature near the ends of the roll. To overcome the steady state drop in temperature at the center of the roll, a heating lamp profile with less boost at its ends is desirable. However, as the lamp profile becomes more uniform, the hot roll temperature at the center of the roll tends to overshoot its operating temperature more during the transient state. Thus, the ability to maintain a relatively uniform temperature across the length of the fuser roll over both the transient and steady state processes is very difficult to achieve. Yet, it is very important to achieve hot roll temperature uniformity since major differences in temperature across the roll result in different qualities of print across the printed page, as well as to wrinkling and other paper damage in various areas of the printed page. Very complex solutions have been proposed for dealing with this issue. For example, some current printers contain complex control algorithms that gradually increase the target or set point temperature at the thermistor position of the hot fuser roll in order to limit the amount of overshoot at the roll center.

A typical fuser roll used in current products, shown in FIG. 2, has a uniform wall thickness across its length. The heating lamp power profile is boosted fifty percent at its end portions, compared to the center portion. The numbers from (1) to (13) in FIG. 2 are used to indicate the positions at which the temperature of the roll is measured, for experimental purposes.

The temperature response and temperature profile for this typical roll are shown in FIGS. 3, 4 and 5. There is a greater than 35° C. temperature droop from center to end in the transient state, and a 23° C. temperature droop from end to center in the steady state. These temperature droops will result in poor printing quality, especially for those products with higher printing speeds because of the shorter residence time of the paper at the fuser roll.

As print speeds increase and it becomes increasingly difficult to achieve fuse grade, it is very desirable to eliminate the variations in temperature described above. Any temperature gradient from end to center of the roll or from transient to steady state potentially reduces fuser performance. Since printer manufacturers are bound on the upper end of the temperature range by material properties and safety concerns, a wider operating temperature range results in a lower minimum operating temperature and thus poorer fuse grades with all else being equal. It would, therefore, be highly desirable to be able to achieve uniformity of temperature on the fuser roll both across the roll lengthwise from end to center and back to end, as well as between the transient and steady states, in a manner which is simple, effective and which does not require extensive modifications to the structure or control software of the printer. The present invention achieves this result in a very simple and effective manner by distributing, in a specifically-defined manner, the thermal mass across the length of the hot fuser roll.

U.S. Pat. No. 5,304,784, Tagashira et al., issued Apr. 19, 1994, describes a resistance heater used for fixing toner in an electrophotographic process. The purpose of the invention is to even out the heat through the fixing process. This is done by manipulating the amount of thermal insulation surrounding various portions of the heater, thereby controlling the amount of heat dissipation from the heater. The heater is designed such that it has a greater amount of insulation at its ends than in the center.

U.S. Pat. No. 5,724,639, Tamura et al., issued Mar. 3, 1998, describes a fixing roller for use in an electrophotographic process which includes an internal heating lamp located within the roller. Black, transparent, silver and white coatings are applied to various portions of the internal roller surface to even out the surface temperature of the roller during the fixing process.

U.S. Pat. No. 4,937,600, Hirabayashi, issued Jun. 26, 1990, describes an algorithm and techniques for adjusting the temperature on the surface of a fixing roll used in an electrophotographic process. This is accomplished primarily by using two different heating voltages which are blended, as appropriate, to keep the fixing temperature within the desired range. Fixing rolls disclosed are shown to have a uniform thickness across their length. The patent teaches, at column 12, that a thicker roll exhibits a slower temperature rise during initial heating. Further, the patent teaches, at columns 5–6, that an increase in roll heat capacity, which is achieved by pre-rotation of the fuser roll in contact with the pinch roller, results in less temperature overshoot during the transient heating phase.

U.S. Pat. No. 4,585,325, Euler, issued Apr. 29, 1986, describes a fixing roll for use in an electrophotographic process. The interior portion of the roll includes two end sections and one middle section, each of which includes separate heating coils. Temperature sensors measure the roll surface temperature and manipulate the heating coils relative to each other in order to make the temperature more uniform over the roll surface. No manipulation of the thermal characteristics of the roll itself is taught.

U.S. Pat. No. 4,639,990, Schiel, et al., issued Feb. 3, 1987, describes a calendar roll for use in a paper making, not an electrophotographic, process. The interior of the roll contains chambers which hold fluid. By controlling the temperature of the fluid in various chambers, the temperature of the roll at various points can be adjusted or made uniform across the length of the roll.

U.S. Pat. No. 5,331,384, Otsuka, issued Jul. 19, 1994, describes a heat fixing apparatus for an electrophotographic process. The Otsuka patent recognizes the problem of temperature differential across the length of the fixing roll and addresses this problem by putting a temperature detection device on the roll beyond the point where the paper passes (i.e., close to the end of the roll) and including an algorithm which adjusts heating of the roll based on that temperature and the size of the paper being printed. The fixing rolls disclosed are of uniform thickness and there is no suggestion to adjust the thickness of the fuser roll.

U.S. Pat. No. 5,481,346, Ohzeki, et al., issued Jan. 2, 1996, describes a heat fixing apparatus for use in an electrophotographic process. This patent recognizes the problem of temperature differentiation between the center and ends of the fuser roll and describes a hardware and software device for minimizing this differential. This is precisely the type of complex solution to the fuser roll temperature problem which the present invention addresses. The fixing rolls disclosed have a uniform thickness and there is no suggestion to adjust the thermal mass of sections of the roll. Similarly, see U.S. Pat. No. 5,742,865, Yajima, et al., issued Apr. 21, 1998.

SUMMARY OF THE INVENTION

The present invention encompasses a hollow fuser hot roll for use in an electrophotographic process comprising a cylindrical shell fabricated from a material that conducts heat (such as aluminum) and has a minimum thickness of about 0.9 mm, said shell made up of a center and two end portions running along its longitudinal axis, wherein the thermal mass per unit length of the center portion is greater than the thermal mass per unit length of said end portions. This difference in thermal mass may be accomplished by either using a higher thermal capacity material in the center portion of the roll as compared with the end portions, or by making the thickness of the center portion of the roll greater than the thickness of each of the end portions, or both.

The present invention also encompasses an image forming apparatus comprising:

means for forming an unfixed image on an image supporting member;

means for fixing the unfixed image on the image supporting member;

said fixing means including a hollow fuser hot roll comprising a cylindrical shell fabricated from a material that conducts heat (for example, aluminum) and has a minimum thickness of about 0.9 mm, said shell made up of a center and two end portions running along its longitudinal axis, wherein the thermal mass per unit length of said center portion is greater than the thermal mass per unit length of said end portions; a means for heating said fuser hot roll; and a pinch roller contacted to said fuser hot roll.

The preferred heating means for use in this apparatus is a heat lamp located inside and surrounded by the hot roll wherein preferably, the lamp has a lower power output at its center portion than at its ends. Most preferably the lamp has a 10% lower power output in its middle portion than its end portions.

DETAILED DESCRIPTION OF THE INVENTION

The present invention relates to the design of a fuser hot roll which is used to fix images in an electrophotographic process. By utilizing this hot roll design, the temperature of the roll, both during the transitory and the steady states, is kept relatively uniform across the length of the roll. This results in a simple, compact fuser design which does not waste energy and which provides high quality images for the user.

Figure 1:
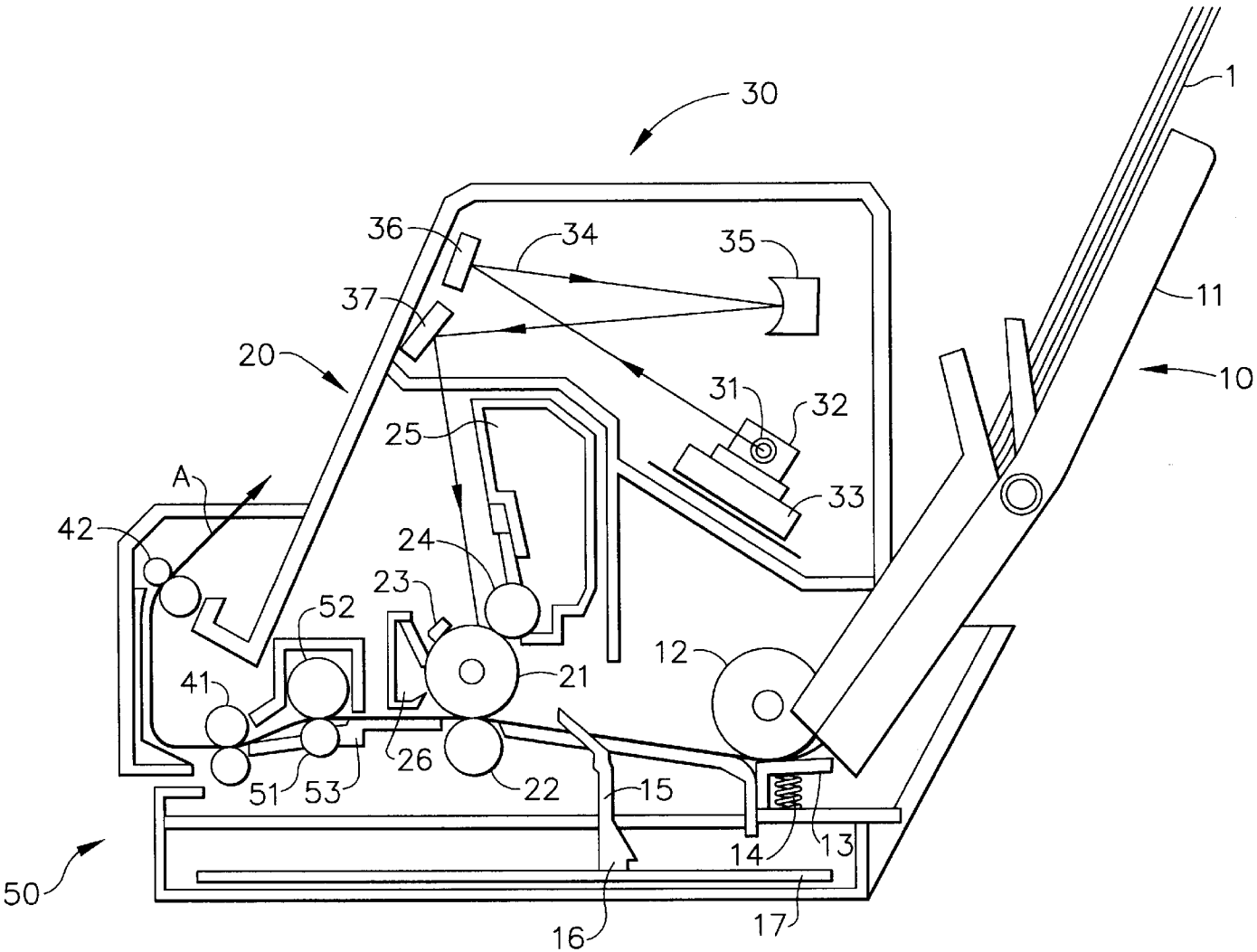
FIG. 1 is a schematic view of a laser printer representing a typical electrophotographic apparatus.

A standard design for a laser printer, a representative electrophotographic device, is shown in FIG. 1. It includes a paper feed section (10), an image forming device (20), a laser scanning section (30), and a fixing device (50). The paper feed section (10) sequentially transports sheets of recording paper (1) to the image forming device (20) provided in the printer. The image forming device (20) transfers a toner image to the transported sheet of recording paper (1). The fixing device (50) fixes toner to the sheet of recording paper (1) sent from the image forming device (20). Thereafter, the sheet of recording paper (1) is ejected out of the printer by paper transport rollers (41 and 42). In short, the sheet of recording paper (1) moves along the path denoted by the arrow (A) of a thick line in FIG. 1.

The paper feed section (10) includes a paper feed tray (11), a paper feed roller (12), a paper separating friction plate (13), a pressure spring (14), a paper detection actuator (15), a paper detection sensor (16) and a control circuit (17).

Upon receiving a print instruction, the sheets of recording paper (1) placed in the paper feed tray (11) are fed one by one into the printer by operation of the printer feed roller (12), the paper separating friction plate (13) and the pressure spring (14). As the fed sheet of recording paper (1) pushes down the paper detection actuator (15), the paper detection sensor (16) outputs an electrical signal instructing commencement of printing of the image. The control circuit (17), started by operation of the paper detection actuator (15), transmits an image signal to a laser diode light emitting unit

(31) of the laser scanning section (30) so as to control on/off of the light emitting diode.

The laser scanning section (30) includes the laser diode light emitting unit (31), a scanning mirror (32), a scanning mirror motor (33), and reflection mirrors (35, 36 and 37).

The scanning mirror (32) is rotated at a constant high speed by the scanning mirror motor (33). In other words, laser light (34) scans in a vertical direction to the paper surface of FIG. 1. The laser light (34) radiated by the laser diode light emitting unit (31) is reflected by the reflection mirrors (35, 36 and 37) so as to be applied to a photo-sensitive body (21). When the laser light (34) is applied to the photo-sensitive body (21), the photo-sensitive body (21) is selectively exposed to the laser light (34) in accordance with on/off information from the control circuit (17).

The image forming device (20) includes the photo-sensitive body (21), a transfer roller (22), a charging member (23), a developing roller (24), a developing unit (25), and a cleaning unit (26). The surface charge of the photo-sensitive body (21), charged in advance by the charging member (23), is selectively discharged by the laser light (34). An electrostatic latent image is thus formed on the surface of the photo-sensitive body (21). The electrostatic latent image is visualized by the developing roller (24) and the developing unit (25). In other words, the toner supplied from the developing unit (25) is adhered to the electrostatic latent image on the photo-sensitive body (21) by the developing roller (24) so as to form the toner image.

Toner used for development is stored in the developing unit (25). The toner contains coloring components (such as carbon black for black ink) and thermoplastic components. The toner, charged by being appropriately stirred in the developing unit (25), adheres to the above-mentioned electrostatic latent image by an interaction of the developing bias voltage applied to the developing roller (24) and an electric field generated by the surface potential of the photo-sensitive body (21), and thus conforms to the latest image, forming a visual image on the photo-sensitive body (21).

Next, the sheet of recording paper (1) transported from the paper feed section (10) is transported downstream while being pinched by the photo-sensitive body (21) and the transfer roller (22). As the sheet of recording paper (1) is transported downstream, the toner image formed on the photo-sensitive body (21) is electrically absorbed and transferred to the sheet of recording paper (1) by an interaction of the electrostatic field generated by the transfer voltage applied to the transfer roller (22). The toner that still remains on the photo-sensitive body (21), not having been transferred to the sheet of recording paper (1), is collected by the cleaning unit (26).

Thereafter, the sheet of recording paper (1) is transported to the fixing device (50). In the fixing device (50), an appropriate temperature and pressure are applied while the sheet of recording paper (1) is being pinched by moving through the nip formed by a press roller (51) and the fixing roller (52) that is maintained at a constant temperature. The thermoplastic components of the toner are melted by the fixing roller and fixed to the sheet of recording paper (1) to form a stable image. The sheet of recording paper (1) is then transported and ejected out of the printer by the paper transport rollers (41 and 42).

Next, the operation of the fixing device (50) will be described in detail. The fixing device (50) includes the pinch roller (51) and the fixing roller (52). The fixing roller (52) is composed of a hollow cylinder (approximately 30 mm in outer diameter and 0.9 mm in thickness in a preferred embodiment) made from a material which conducts heat, such as aluminum, and the outer surface of which is coated with a synthetic resin material having good mold release, paper transport and heat resistance properties. An example of this coating is the synthetic resin material fluororesin for its mold release properties, used together with heat resistant rubber such as a silicone rubber for its good paper transport properties. These materials are mixed, applied to the surface of the roller and then baked. The roller itself is made from a material which conducts heat and which has sufficient structural integrity such that it maintains its shape when it is used against a press roller (51) to form a nip through which the printed pages travel. Typically the pressure between the fuser roller (52) and the press roller (51) is from about 15 to about 25 psi. The fuser roller (52) may be of any length depending upon the machine involved; it typically is about 230 to about 240 mm in length and is made from a material being at least about 0.9 mm thick. The materials used to make the hot fuser roller (52) generally have a high thermal conductivity and a relatively low thermal capacity. Preferred materials are those selected from aluminum, copper, steel and mixtures thereof. The most preferred material is aluminum, because of its excellent thermal properties and its relatively low cost. A heater lamp is placed within the hollow portion of the fuser roller. The heater lamp serves as the method by which the fuser roller (52) is heated during use.

The press roller (51) is also cylindrical in shape. It is made from or is coated with a material which has good release and transport properties for the paper (1). The press roller (51) is sufficiently soft so as to allow it to be rotated against the fuser roller (52) to form a nip through which the printed pages travel. By going through this nip, printed pages are placed under pressure and the combined effects of this pressure and heat from the fuser roller (52) act to fix the toner into the paper. A preferred material for use in forming the press roller (51) is silicon rubber. The roller has an aluminum core with a silicon rubber layer glued on its surface.

Figure 6:
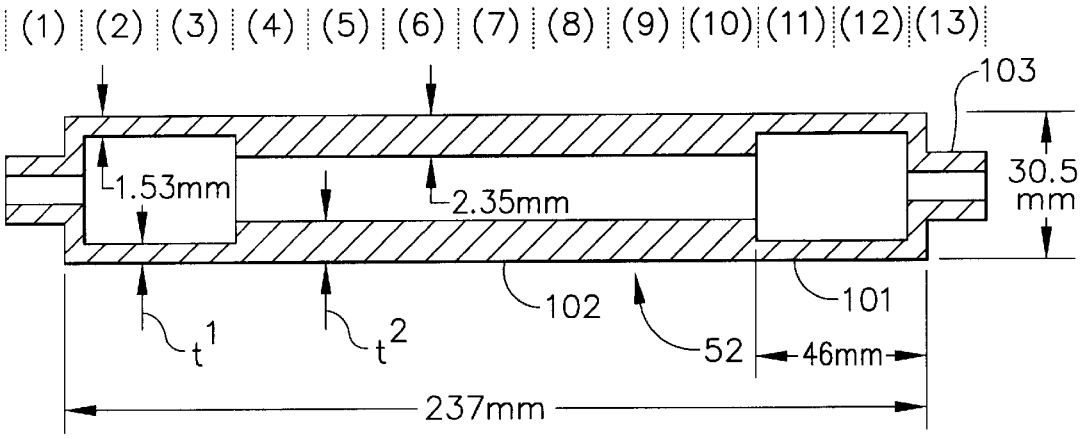
FIG. 6 is a cutaway view of a fuser roll of the present invention showing the distribution of thermal mass across the length of the roll.

The key to the present invention is that the thermal mass of the center of the fuser roller (52) is greater than the thermal mass at each of the two end portions of the fuser roller. For definitional purposes, the fuser roller (52) itself may be divided along its longitudinal axis (length) into two end portions and a center portion. FIG. 6 is a cross-sectional view, cut along the length, of a fuser roller (52). In that Figure, the end portions of the roller are represented by the numbers 101 and the center portion of the roller is represented by 102. 103 represents the connector portions of the roller through which the roller is connected to the remainder of the fuser mechanism. The length of the fuser roller (52) may vary greatly depending upon the particular type of machine it is incorporated into. In a preferred embodiment, the entire fuser roller (52) is from about 230 to about 240 mm in length. The end portions of this roller (101) are generally from about 40 to about 50 mm in length each. The two end portions may have the same length or be of different lengths. Therefore, the center portion (102) of this roller typically is from about 130 mm to about 160 mm in length. The preferred center portions are from about 145 mm in length.

As stated above, the crux of the present invention is that the center portion of the fuser roller (102) has a greater thermal mass (e.g., thermal mass per unit length) than either of the two end portions of the fuser roller (101). This can be accomplished in a number of ways. For example, the center portion of the roller (102) can be made from a material that has a higher thermal capacity than the material which makes up the end portions of the roller (101). While this approach is effective, it generally tends to result in a more expensive roller, since the roller needs to be made out of two separate materials, thereby increasing the manufacturing costs. A simpler and less expensive way of accomplishing the result is to fabricate the roller from a single material but to make the center portion thicker than either of the end portions of the roller. This embodiment is illustrated in FIG. 6. Thus, in that Figure, the center portion (102) has a thickness (t2) which is greater than the thickness (t1) of the end portions of the roller (101). The thickness of the center portion of the roller, particularly when it is made from aluminum, generally will range from about 2 to about 2.5 mm, most preferably about 2.35 mm. The thickness of the end portions of the roller will range from about 1.2 mm to about 1.5 mm, most preferably about 1.33 mm. Looked at another way, in preferred rollers, the ratio of the thickness of the center portion to the thickness of the end portions is from about 1.5 to about 2.0, preferably about 1.75.

When the fuser roller (52) is fabricated from a single material, there are essentially two ways to adjust the total thermal mass of the center portion (102) and the end portions (101): adjusting the thickness of the center portion (102) as compared to the end portions (101), and adjusting the length of the center portion (102) versus the length of the end portions (101). Thus, greater thickness results in greater thermal mass. Similarly, greater length results in greater thermal mass. Following logically from this, increasing the thickness and the length of the center portion (102) of the fuser roller, as compared to that of the end portions (101), would provide the greatest difference in thermal mass.

Any heating mechanism known in the art (for example, heat lamps or resistance heaters) can be used to heat the fuser hot roller (52). Preferably, the fuser hot roller (52) is heated during use by a heat lamp which is placed within the empty cavity of the hot roller. Such heat lamps are well known in the electrophotographic arts. In particularly preferred embodiments, the heat lamp, which typically has power ranging from about 750 to about 1,000 watts, preferably about 875 watts, has a greater power output in its end portions than at its center portion. As used herein, the center portion of the lamp comprises about 50% of the length of the lamp, while each end portion comprises about 25%. In the most preferred embodiment, the heat lamp has a power output in its center portion which is about 10% lower than the power output at its end portions.

In typical fuser roller operation, the center portion of the hot fuser roller heats up more quickly than the end portions. If, in an attempt to compensate for this, the heating temperatures at the end portions are boosted, the center portion of the fuser roller overshoots its target temperature by a considerable amount, potentially causing damage to the printer and to the printed page. In this conventional fuser roller operation, once it has reached a steady state, the temperature in the center of the roller tends to decrease and be less than the temperature at the end portions. This difference in the temperature of the center of the fuser roller between the transitory state and the steady state results in a printed page which has different properties and qualities depending on whether it is printed early or later in the printing run. Using the fuser roller of the present invention, particularly if it is used with a heat lamp having an end power boost, particularly a 10% end power boost, these problems are overcome, with a transitory state wherein the center and end portions of the roller are very close to the target temperature and where there is minimal overshoot in the center of the roller, and a steady state wherein the center and end portions of the roller are also very close to the target temperature. This provides printed pages with a uniform quality throughout the print run.

Figure 2:
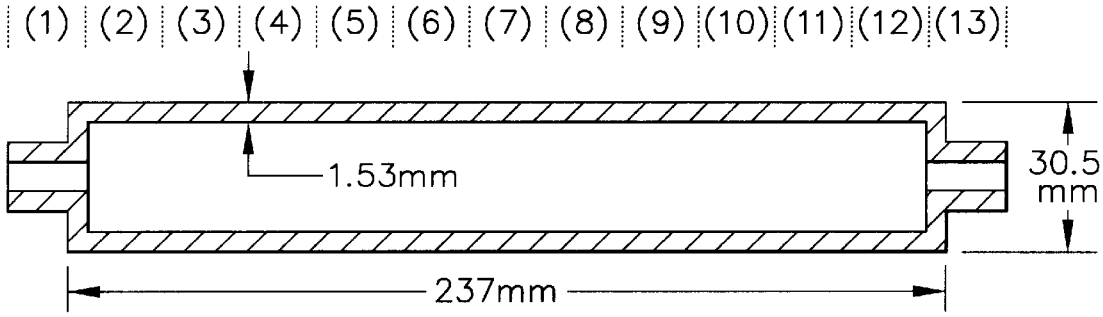
FIG. 2 is a cutaway view of a typical fuser roll having a uniform wall thickness across its length.
Figure 3:
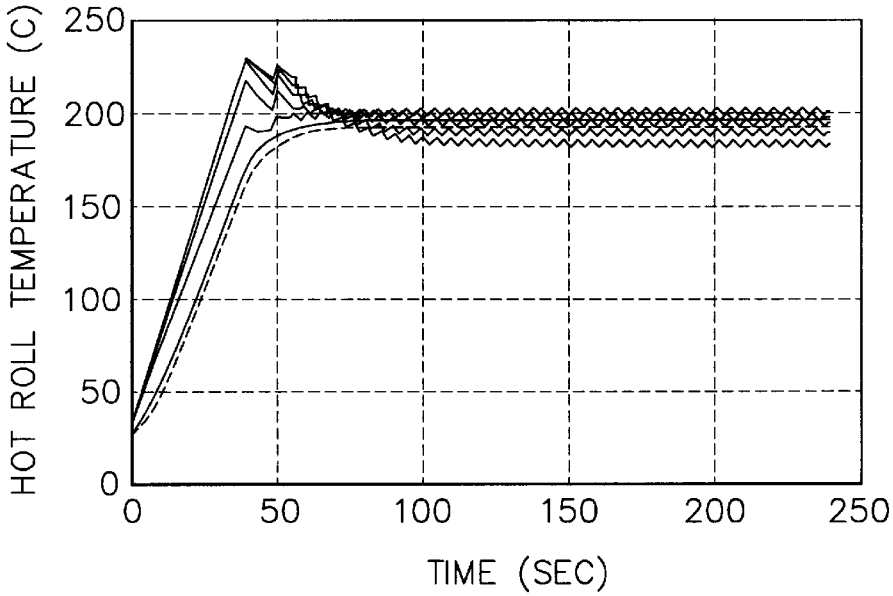
FIGS. 3, 4, and 5 show the temperature response and temperature profile of the fuser roll shown in FIG. 2 with a heat lamp of 50% power boosted at its ends.
Figure 4:
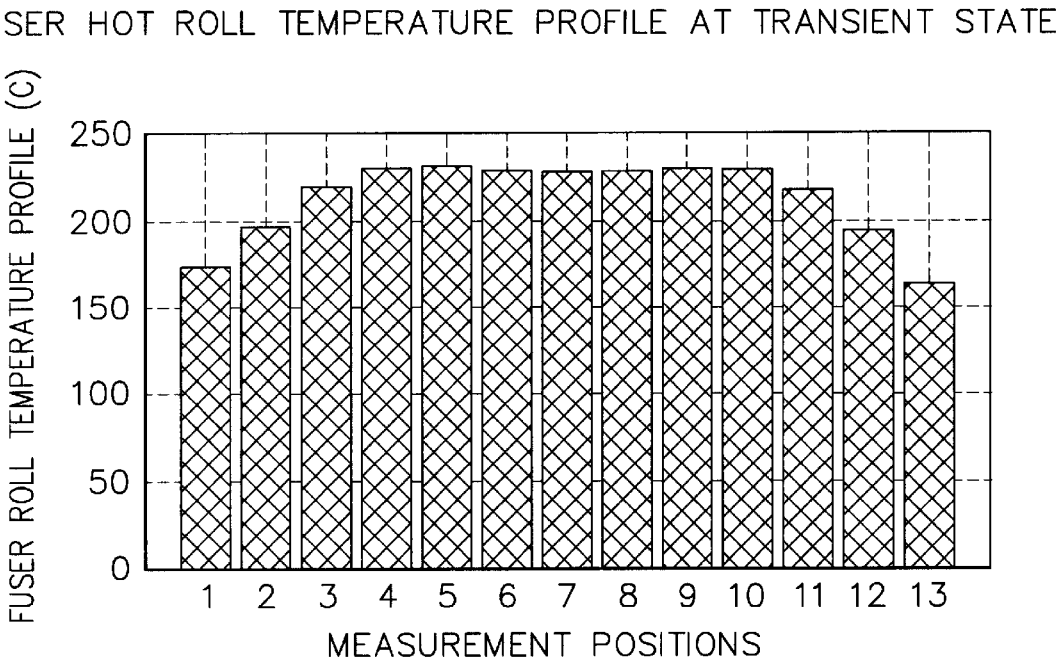
Figure 5:
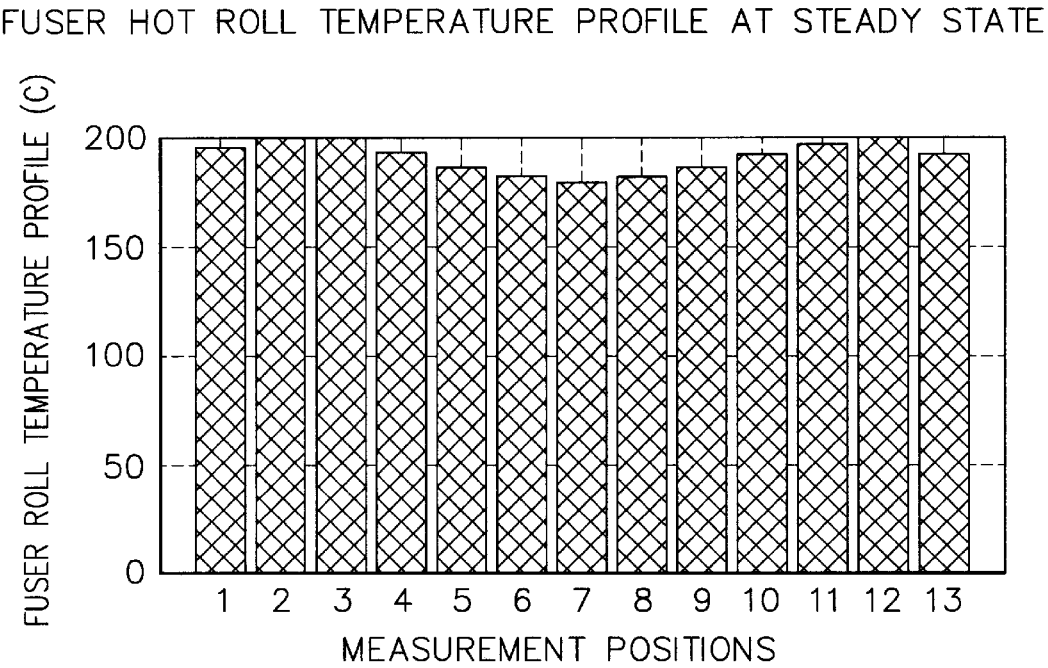

To summarize, the following points are important to the operation of the present invention:

(1) The temperature of a fuser hot roll, during operation, varies from its end to its center. In a typical roll (such as FIG. 2), the roll temperature profile crosses over from transient state to steady state.

(2) The heat lamp power profile affects the roll temperature profile for both the transient and steady states.

(3) Thermal mass distribution of a fuser roll has primary influence on the transient temperature profile and does not significantly affect the steady state temperature profile of the roll.

(4) Material heat capacity per unit length of a fuser roll has primary influence on the transient temperature profile and does not significantly affect the steady state temperature profile of the roll.

(5) The fact that thermal mass and material heat capacity primarily affect only the transient temperature profile of the roll is key to achieving a uniform temperature profile for both the transient and steady states, since it permits tuning of the thermal mass to achieve the desired transient profile without affecting the steady state profile.

EXAMPLE

The following example illustrates the fuser rolls of the present invention and the way it is utilized to provide a uniform temperature profile for both the transient and steady states.

Step 1: Design Lamp Power Profile

Figure 7:
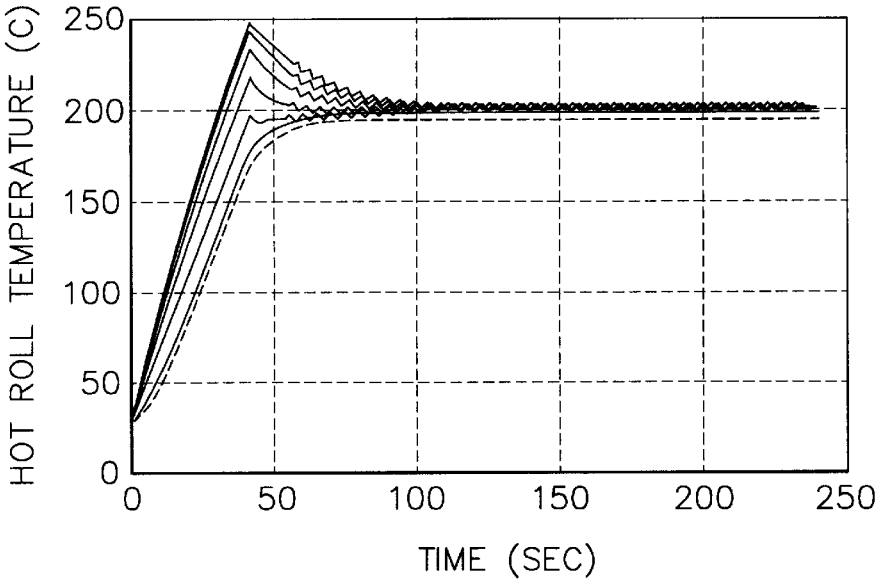
FIGS. 7, 8 and 9 show the temperature profiles for the fuser roll shown in FIG. 2 with a heat lamp of uniform power across its length.

The lamp power profile is determined based on the desire to have a uniform steady state temperature profile. A uniform lamp power profile will produce a uniform steady state temperature profile because thermal mass distribution of a fuser roll has no significant effects on its steady state temperature profile. Therefore, the uniform lamp power profile is chosen first no matter what the thermal mass distribution of a fuser roll is. For a roller with uniform wall thickness shown in FIG. 2, the temperature response of the fuser hot roll heated by a lamp with a uniform power profile is indicated by FIG. 7. It achieves a uniform temperature profile at steady state shown in FIG. 9, but results in about a 50° C. temperature difference from the end to the center at transient state in FIG. 8. It will produce very poor fuse grades for first several pages.

Step 2: Tuning Thermal Mass

Figure 8:
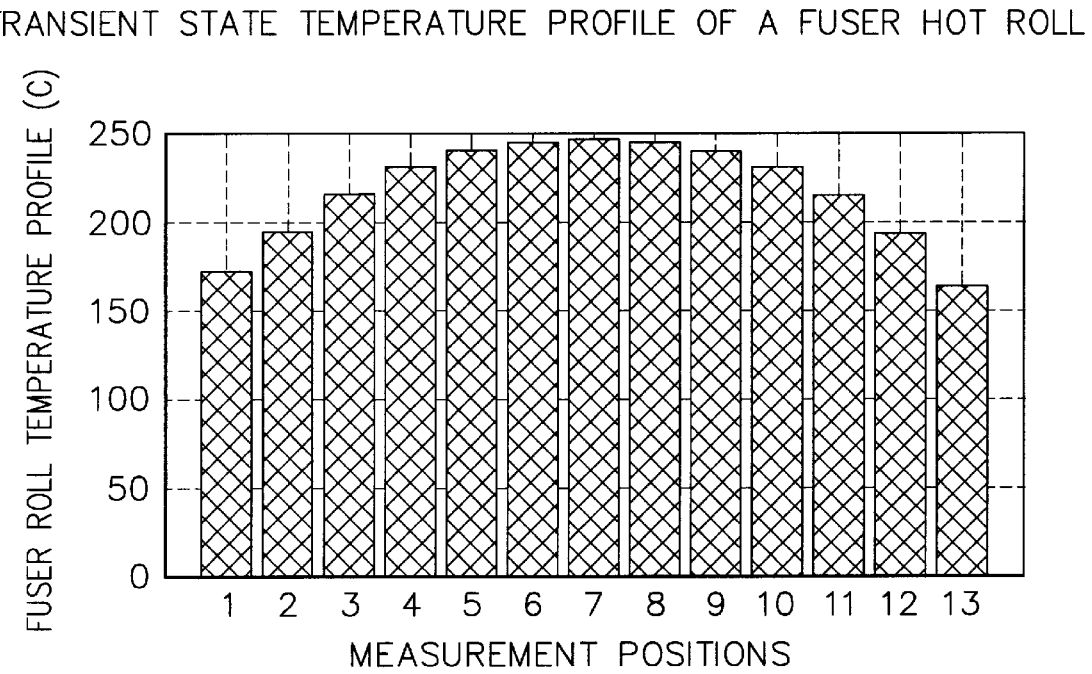
Figure 9:
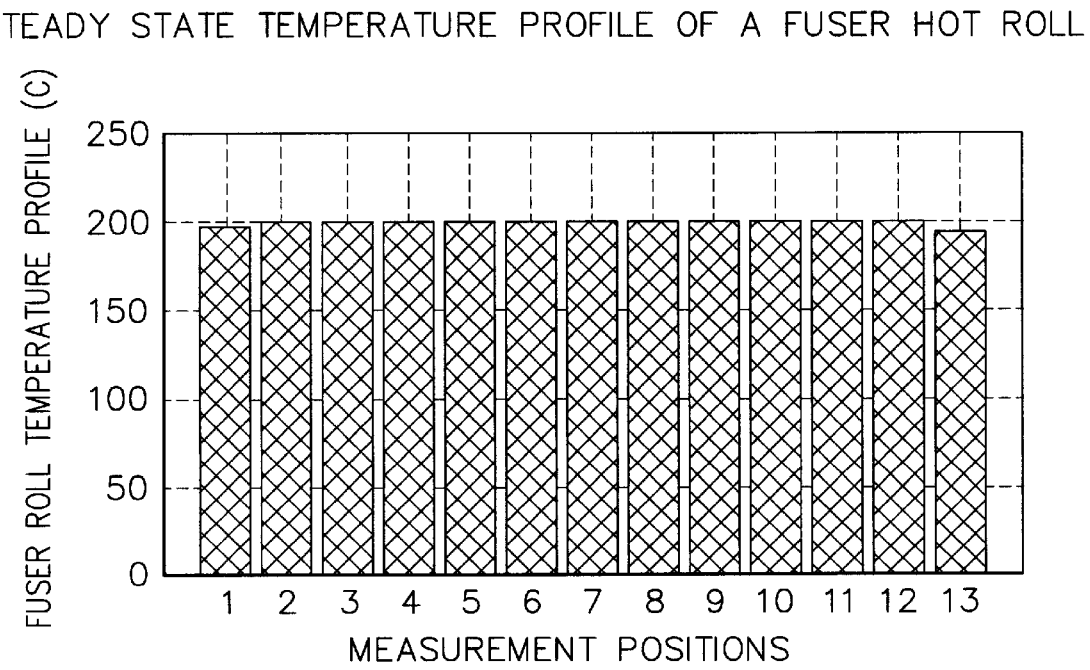

The roller with uniform wall thickness heated by a lamp with a uniform power profile results in an uniform temperature profile at steady state and a big temperature droop at transient state (see FIG. 8 and FIG. 9). To achieve a uniform transient profile without affecting the steady state temperature profile, either the thermal mass or material thermal capacity can be tuned to greatly reduce the transient temperature droop.

Tuning thermal capacity

A fuser hot roll can be made from different materials. The center portion of the roll can be made from a material that has a higher thermal capacity than the material that is used to fabricate the end portions of the roll. While this approach is effective, it is not frequently a practical solution because this roll is more difficult and more expensive to make than a roll fabricated from a single material.

Tuning thermal mass

A simple and less expensive way to eliminate the transient temperature droop from end to center of the fuser roll is to tune the thermal mass distribution of the roll. The roll is fabricated from a single material with its center portion thicker than either of its end portions. The wall thickness of the roll can be a function of its length position and can be smoothly and gradually reduced from the center to the end. For a roll that is easier to fabricate and lower in cost, the wall thickness of the roll is stepped down from the center portion to the end portion, shown in FIG. 6.

Figure 10:
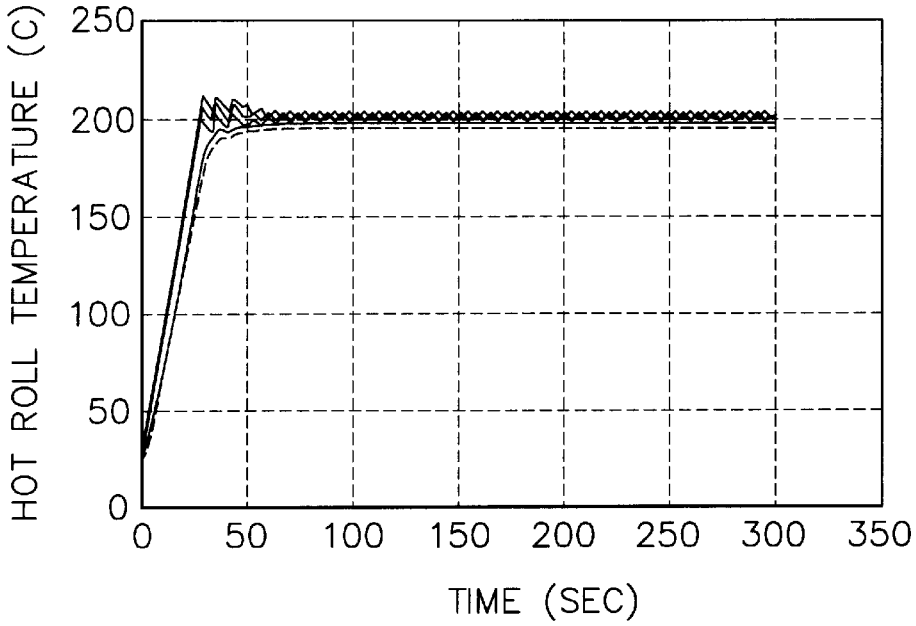
FIGS. 10, 11 and 12 show the temperature profiles for the fuser roll shown in FIG. 6 using a heat lamp of uniform power across its length.
Figure 11:
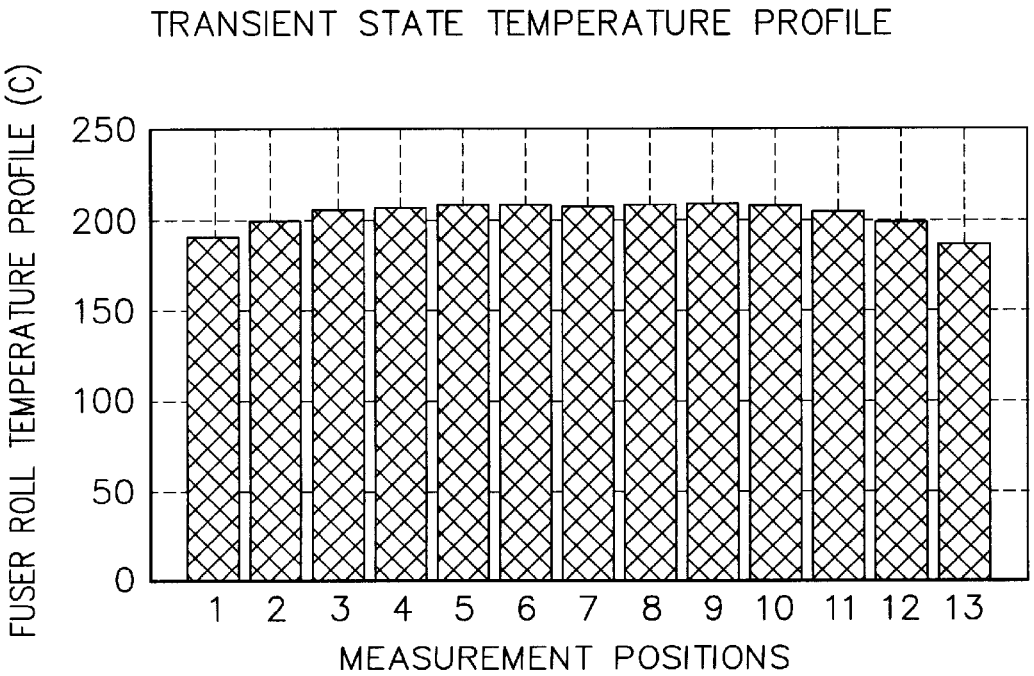
Figure 12:
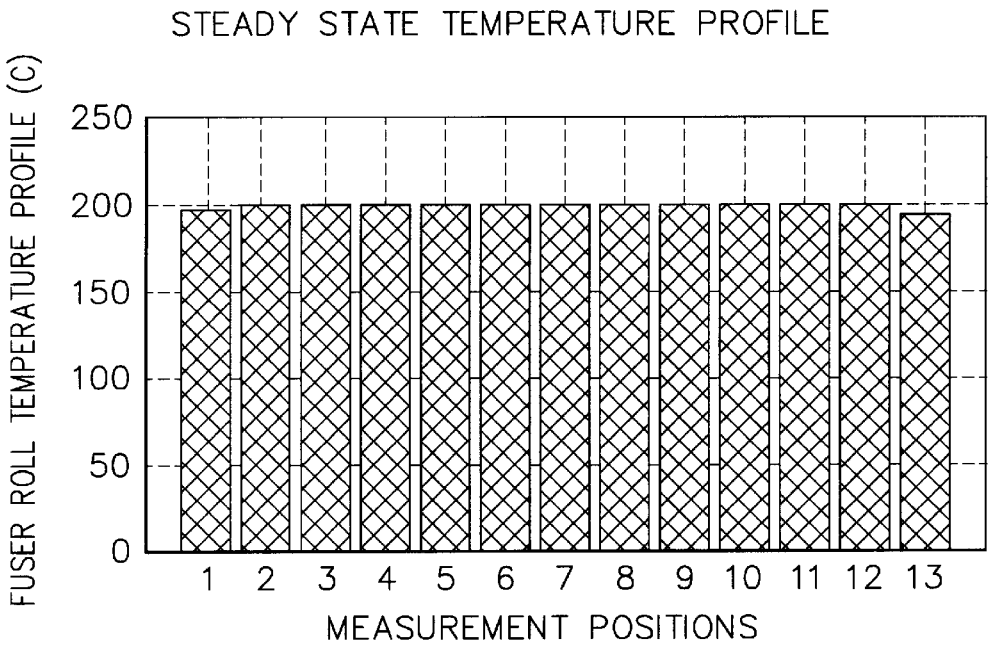

The temperature response of the fuser hot roll that has the distributed thermal mass indicated by FIG. 6 and is heated by a lamp with uniform power profile is shown in FIG. 10. The transient and steady state temperature profiles are shown in FIG. 11 and FIG. 12, respectively. From FIG. 11, it is seen that the temperature difference of the fuser hot roll from the end to the center at transient state is greatly reduced to less than 10° C., compared to the 50° C. temperature difference shown in FIG. 8 for the roller with uniform wall thickness.

Step 3: Thermal Load Compensation

For simplicity, uniform thermal load during printing is assumed in design Step 1 and Step 2. But, the thermal load is actually not uniform because the nip width is wider at the end portions and narrower at the center portion and heat is conducted at the roller ends to the support bearings and support structure for the roll. To compensate for higher thermal load at the end portions, lamp power at the end portions is boosted 10 percent higher than that at the center portion.

Figure 13:
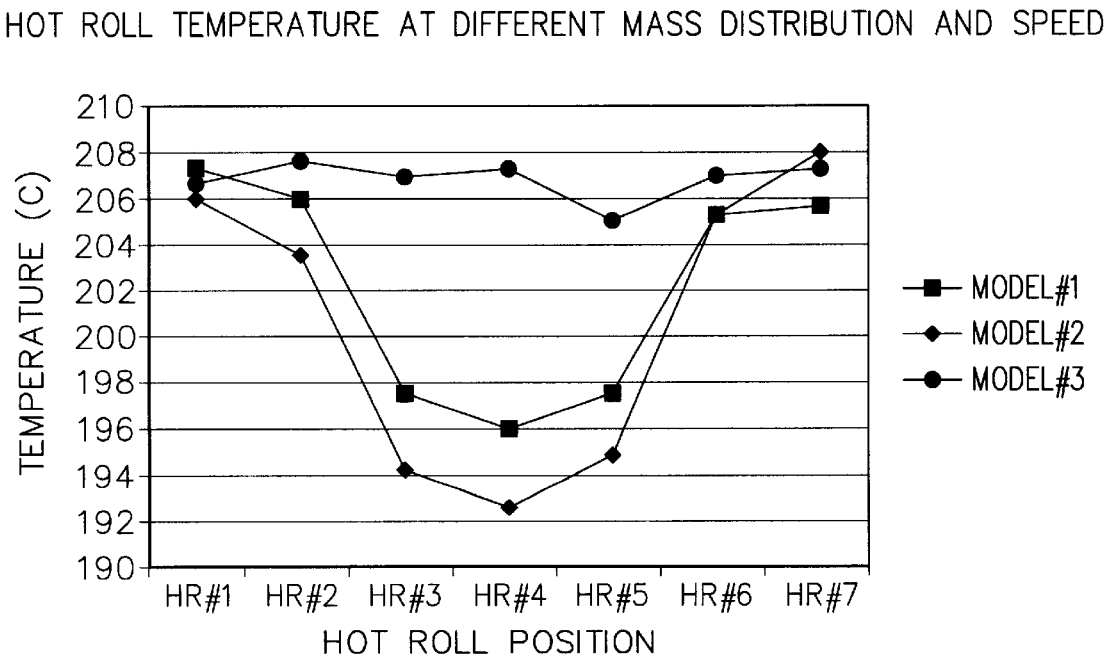
FIG. 13 shows the comparative fuser roll temperatures for three different rolls.

FIG. 13 shows the uniformity of hot roll temperature for three different fuser models. Model #1 is a hot roll with uniform wall thickness across its length (see FIG. 2) that is heated by a lamp with a power profile that is 50 percent boosted at its end portions. Model #2 has the same hot roll and lamp as model #1, but is used at a higher print speed (pages per minute). Model #3 has a hot roll with the distributed thermal mass as shown in FIG. 6 and a lamp that is 10 percent power boosted at its end portions compared to its center portion. From FIG. 13, it is seen that model #1 has a greater than 10° C. temperature droop in the center of the hot roll at steady state printing. As printing speed increases, the temperature droop gets deeper, which is indicated by model #2. In the worst case, the temperature droop could exceed 23° C. Model #3 demonstrates that the fuser roll of the present invention has no temperature droop and provides better printing quality, even at a printing speed higher than that of model #2.

What is claimed is:

1. A hollow fuser hot roll assembly for use in an electrophotographic process comprising a fuser hot roll comprising a cylindrical shell having an empty, internal cavity fabricated from a material that conducts heat and has a minimum thickness of about 0.9 mm, said shell made up of a center portion and two end portions running along its longitudinal axis, wherein the thermal mass per unit length of said center portion is greater than the thermal mass per unit length of each of said end portions, and a heating mechanism is said cavity to provide power output in said center portion which is about 10% lower than power output at said end portions.

2. The fuser hot roll assembly according to claim 1 where in the center portion comprises a material having a higher thermal capacity than the material comprising the end portions.

3. The fuser hot roll assembly according to claim 1 made from a material having a high thermal conductivity and a relatively low thermal capacity.

4. The fuser hot roll assembly according to claim 3 made from a material selected from the group consisting of aluminum, cooper, steel, and mixtures thereof.

5. The fuser hot roll assembly according to claim 1 wherein the thickness of the center portion of said roll is greater than the thickness of each of the end portions of said roll.

6. The fuser hot roll assembly according to claim 4 wherein the thickness of the center portion of said roll is greater than the thickness of each of the end portions of said roll.

7. The fuser hot roll assembly according to claim 6 made from aluminum.

8. The fuser hot roll assembly according to claim 7 wherein the ratio of the center thickness of said roll to the end thickness of said roll is from about 1.5 to about 2.0.

9. The fuser hot roll assembly according to claim 8 wherein the ratio of the center thickness of said roll to the end thickness of said roll is about 1.75.

10. The fuser hot roll assembly according to claim 7 wherein the thickness of the center portion of said roll is from about 2 mm to about 2.5 mm, and the thickness of the end portions of said roll are from about 1.2 mm to about 1.5 mm.

11. The fuser hot roll assembly according to claim 10 wherein the thickness of the center portion of said roll is about 2.35 mm and the thickness of the end portions of said roll is about 1.33 mm.

12. The fuser hot roll assembly according to claim 5 wherein the ratio of the length of the center portion of said roll to the length of each of the end portions of said roll is from about 3 to about 10.

13. The fuser hot roll assembly according to claim 12 wherein the ratio of the length of the center portion of said roll to the length of each of the end portions of said roll is from about 3 to about 7.

14. The fuser hot roll assembly according to claim 10 where in the ratio of the length of the center portion of said roll to the length of the end portion of said roll is from about 3 to about 7.

15. The fuser hot roll assembly according to claim 11 wherein the length of the center portion of said roll is from about 130 mm to about 160 mm and the length of each of the end portions of said roll is from about 40 mm to about 50 mm.

16. An image forming apparatus comprising:

means for forming an unfixed image on an image supporting member;

means for fixing the unfixed image on the image supporting member;

said fixing means including a hollow fuser hot roll comprising a cylindrical shell fabricated from a material that conducts heat and has a minimum thickness of about 0.9 mm, said shell made up of a center and two end portions running along its longitudinal axis, wherein the thermal mass per unit length of said center portion is greater than the thermal mass per unit length of each of said end portions; a means for heating said fuser hot roll; and a backup pressure roller contacted to said fuser hot roll, said means for heating providing power output in said center portion which is about 10% lower than power output at said end portions.

17. The image forming apparatus according to claim 16 wherein the heating means is a heat lamp located inside and surrounded by said fuser hot roll.

18. The image forming apparatus according to claim 17 wherein the fuser hot roll is made from a material selected from the group consisting of aluminum, copper, steel, and mixtures thereof.

19. The image forming apparatus according to claim 18 wherein the thickness of the center portion of said fuser hot roll is greater than the thickness of each of the end portions of said fuser hot roll.

20. The image forming apparatus according to claim 19 wherein the fuser hot roll is made from aluminum.

21. The image forming apparatus according to claim 20 wherein, in the fuser hot roll, the ratio of the thickness of the center portion to the thickness of each of the end portions is from about 1.5 to about 2.0.

22. The image forming apparatus according to claim 21 wherein the fuser hot roll, the thickness of the center portion is from about 2 mm to about 2.5 mm, and the thickness of each of the end portions is from about 1.2 mm to about 1.5 mm.

23. The image forming apparatus according to claim 22 wherein, in the fuser hot roll, the thickness of the center portion is about 2.35 mm, and the thickness of each of the end portions are about 1.33 mm.

24. The image forming apparatus according to claim 22 wherein, in the fuser hot roll, the ratio of the length of the center portion to the length of each of the end portions is from about 3 to about 7.

25. The image forming apparatus according to claim 23 wherein, in the fuser hot roll, the length of the center portion is from about 130 mm to about 160 mm, and the length of each of the end portions is from about 40 mm to about 50 mm.

* * * * *